US008407959B2

(12) United States Patent
Ytterberg

(10) Patent No.: US 8,407,959 B2
(45) Date of Patent: Apr. 2, 2013

(54) ELASTIC RESTRAINT SYSTEM FOR SHRINKAGE COMPENSATING CONCRETE SLAB

(76) Inventor: Donald G. W. Ytterberg, Evergreen, CO (US)

( * ) Notice: Subject to any disclaimer, the term of this patent is extended or adjusted under 35 U.S.C. 154(b) by 0 days.

(21) Appl. No.: 13/066,997

(22) Filed: Apr. 29, 2011

(65) Prior Publication Data

US 2012/0272600 A1 Nov. 1, 2012

(51) Int. Cl.
*E04B 1/18* (2006.01)
*E04B 2/00* (2006.01)
*E04C 5/00* (2006.01)

(52) U.S. Cl. ..... 52/414; 52/223.6; 52/659; 52/649.1; 52/432

(58) Field of Classification Search ..... 52/414, 52/223.6, 677, 659, 649.1, 432
See application file for complete search history.

(56) References Cited

U.S. PATENT DOCUMENTS 2,458,242 A * 1/1949 Bescherer ..... 52/659
3,195,277 A * 7/1965 Greulich ..... 52/223.6
3,292,317 A * 12/1966 Barrett ..... 52/81.6
3,522,685 A * 8/1970 Oroschakoff ..... 52/432
4,156,997 A * 6/1979 Decker et al. ..... 52/223.6
4,432,175 A * 2/1984 Smith ..... 52/223.6
6,435,765 B1 * 8/2002 Crane et al. ..... 404/31
6,443,666 B1 * 9/2002 Smith ..... 405/286
6,470,640 B2 * 10/2002 Ytterberg ..... 52/414
7,404,690 B2 * 7/2008 Lukasik et al. ..... 404/36
2002/0050110 A1 * 5/2002 Ytterberg ..... 52/414
2003/0110724 A1 * 6/2003 Haussler ..... 52/414
2006/0201393 A1 * 9/2006 Rice et al. ..... 106/644
2008/0083181 A1 * 4/2008 Ospina ..... 52/334
2010/0154332 A1 * 6/2010 Shockley et al. ..... 52/223.3
2012/0151860 A1 * 6/2012 Li ..... 52/340

* cited by examiner

*Primary Examiner* — Mark Wendell
(74) *Attorney, Agent, or Firm* — Scott. L. Terrell, P.C.; Scott L. Terrell

(57) ABSTRACT

A reinforced shrinkage compensating concrete slab has a major outer and inner faces defining a slab thickness and a centroid portion surrounded by a peripheral portion having outer peripheral edges defining a bulkhead length and width. A first plurality of reinforcing bars is embedded within the concrete slab on a plane which is substantially parallel to the major outer and inner faces. The first reinforcing bars extend in a first array having a first dimension defining a first on-centers-each-way orientation. A second plurality of reinforcing bars is embedded within the peripheral portion of the concrete slab in a second array which is a substantially intersecting and coplanar construction in relation to the first reinforcing bars. The second plurality of reinforcing bars are restricted to the peripheral portion and aligned with the expansive and shrinkage forces on a second dimension defining a second on-centers-each-way orientation so that the expansive and shrinkage forces are restrained.

5 Claims, 3 Drawing Sheets

ELASTIC RESTRAINT SYSTEM FOR SHRINKAGE COMPENSATING CONCRETE SLAB

CROSS REFERENCE TO RELATED APPLICATIONS

None.

STATEMENT OF FEDERALLY SPONSORED RESEARCH

None.

BACKGROUND OF THE INVENTION

1. Technical Field

The present invention relates to shrinkage compensating concrete slab structures. In particular, it relates to a reinforced shrinkage compensating concrete slab structure having first and second reinforcing bar arrays which define a centroid and peripheral portions so that active expansive and shrinkage forces are restrained.

2. Background Art

The construction of shrinkage compensating concrete slab structures is generally known. Such constructions are sometimes referred to as "self-stressing concrete" and to "chemically prestressed concrete." Unlike traditional Portland cement based concrete, the shrinkage compensating concrete has a constituent that actively causes the concrete to volumetrically enlarge. According to the American Concrete Institute ("ACI"), shrinkage compensating concrete means "a concrete that, when strained by reinforcement or other means, expands . . . [and] ideally, a residual expansion will remain in the concrete, thereby eliminating shrinkage cracking." The restraint of cracking in shrinkage compensating concrete is thus elemental to its function.

Unlike prestressed concrete and post-tensioned concrete, where the concrete is passive and the restraint actively acting upon the concrete from either pre- or post-tensioning the reinforcement, shrinkage compensating concrete generates its own expansive forces which, in turn, tension the reinforcement. ACI further references the term restraint as meaning "a resilient type of restraint, such as that provided by internal reinforcement, shall be provided to develop shrinkage compensation. Other types of restraint, such as adjacent structural elements, sub-grade friction, and integral abutments are largely indeterminate and provide either too much or too little restraint."

Industry guidelines further provide definitive provisions which relate to the amount of reinforcement required to restrain shrinkage in shrinkage compensating concrete slabs. These guidelines provide guidance as to an accepted volume and presence of embedded steel reinforcing bars in relation to the cross-sectional area of concrete to be poured. However, the overall design configuration of the actual layout of the reinforcing bars is largely left to the one who specifies the job excepting, however, certain recommendations as to the configuration of the construction of the slab with wire mesh and/or deformed reinforcing bar in a two-way reinforcement pattern.

Related technologies are also disclosed which relate to the science of making and using various pre-tension and post-tension methods and constructions with plastic coated wire, cable, and certain reinforcing bar designs for dealing with the compressive forces acting on the slab during its construction. However, such methods and materials, including the use of tension bands are costly, time consuming, and require the use of passive concrete and active compression dynamics. For example, U.S. Pat. No. 2,035,007, to Workman, discloses a concrete construction where the structure includes subdivided circular areas producing circumferential stress bands areas alternating between compressive stresses in the alternative bands.

Moreover, U.S. Pat. No. 3,513,609, to Lang, discloses the use of reinforcing "tendons", of a plastic coated wire having a low friction interface between the wire and the coating. The tendons are integrated in a common plane for use in post-tensioning a concrete construction. U.S. Pat. No. 3,710,526, to Parks, discloses a floor construction wherein pre or post stressed, radially extending tendons are placed within an annular compression beam. In this construction, a reinforced annular girder is precast. After the cement has set high tensile, radially extending tendons are prestressed. Concrete is then placed in areas defined as a web and annulus slab. After the concrete has set the tension is relieved, and the beam is ready for use as floor construction.

Certain disclosures illustrate the use of a reinforcing bar configuration to elastically restrain expansive and shrinkage forces in a concrete slab construction. For Example, U.S. Pat. No. 6,470,640, to Ytterberg, discloses a reinforced concrete building structure including a shrinkage compensating concrete slab. The slab includes a plurality of deformed reinforcing bars embedded therein. The bars are restricted to a peripheral portion of the slab, which surrounds the centroid of the slab, devoid of reinforcement, and are aligned with the expansive and shrinkage forces to elastically restrain the forces and to thereby act as an internally developed tension ring.

While the foregoing methods and materials are useful in providing designs for the construction of shrinkage compensating concrete slab structures, there is still a need for alternate constructions which are useful to elastically restrain the expansive and shrinkage forces upon a shrinkage compensating slab structure, but which are characterized, by certain criteria including overall simplicity and economy in construction. The present invention satisfies these needs.

SUMMARY OF THE INVENTION

Therefore, it is an object of the present invention to provide a reinforced shrinkage compensating concrete slab construction which is useful to elastically restrain the expansive and shrinkage forces upon a shrinkage compensating slab structure, but which is characterized by overall simplicity and economy in construction.

To overcome the problems associated with the prior art methods, and in accordance with the purpose of the present invention, as embodied and broadly described herein, briefly a reinforced concrete building structure is provided. A shrinkage compensating concrete slab has major outer and inner faces defining a slab thickness and a centroid portion surrounded by a peripheral portion having outer peripheral edges defining a bulkhead length and width. Active expansive and shrinkage forces are normally concentrated in the peripheral portion. A first plurality of reinforcing bars is embedded within the concrete slab on a plane which is substantially parallel to the major outer and inner faces. The first reinforcing bars extend in a first array having a first dimension defining a first on-centers-each-way orientation and a centroid portion of the slab. A second plurality of reinforcing bars is embedded within the peripheral portion of the concrete slab in a second array which is a substantially intersecting and coplanar construction in relation to the first reinforcing bars. The second plurality of reinforcing bars are restricted to the peripheral portion and aligned with the expansive and shrinkage forces on a second dimension defining a second on-centers-each-way orientation and the peripheral portion of the slab so that the expansive and shrinkage forces are elastically restrained.

Additional advantages of the present invention will be set forth in part in the description that follows, and, in part, will be obvious from that description or can be learned from practice of the invention. The advantages of the invention can be realized and obtained by the apparatus particularly pointed out in the appended claims.

BRIEF DESCRIPTION OF THE SEVERAL VIEWS OF THE DRAWINGS

The accompanying drawings, which are incorporated in and which constitute a part of the specification, illustrate at least one embodiment of the invention and, together with the description, explain the principles of the invention.

DETAIL DESCRIPTION OF THE INVENTION

Unless specifically defined otherwise, all technical or scientific terms used herein have the same meaning as commonly understood by one of ordinary skill in the art to which this invention belongs. The term "Imperial" when used in relation to reinforcing size, refers to the standard Imperial sized bar designations which represent the bar diameter in fractions of ⅛ inch, such that #4 equals ⅝ of an inch or 0.5 inches in diameter.

Although any of the methods and materials similar or equivalent to those described herein can be used in the practice or testing of the present invention, the preferred methods and materials are now described. Reference will now be made in detail to the presently preferred embodiments of the invention, examples of which are illustrated in the accompanying drawings wherein like numerals represent like features of the invention.

Figure 1:
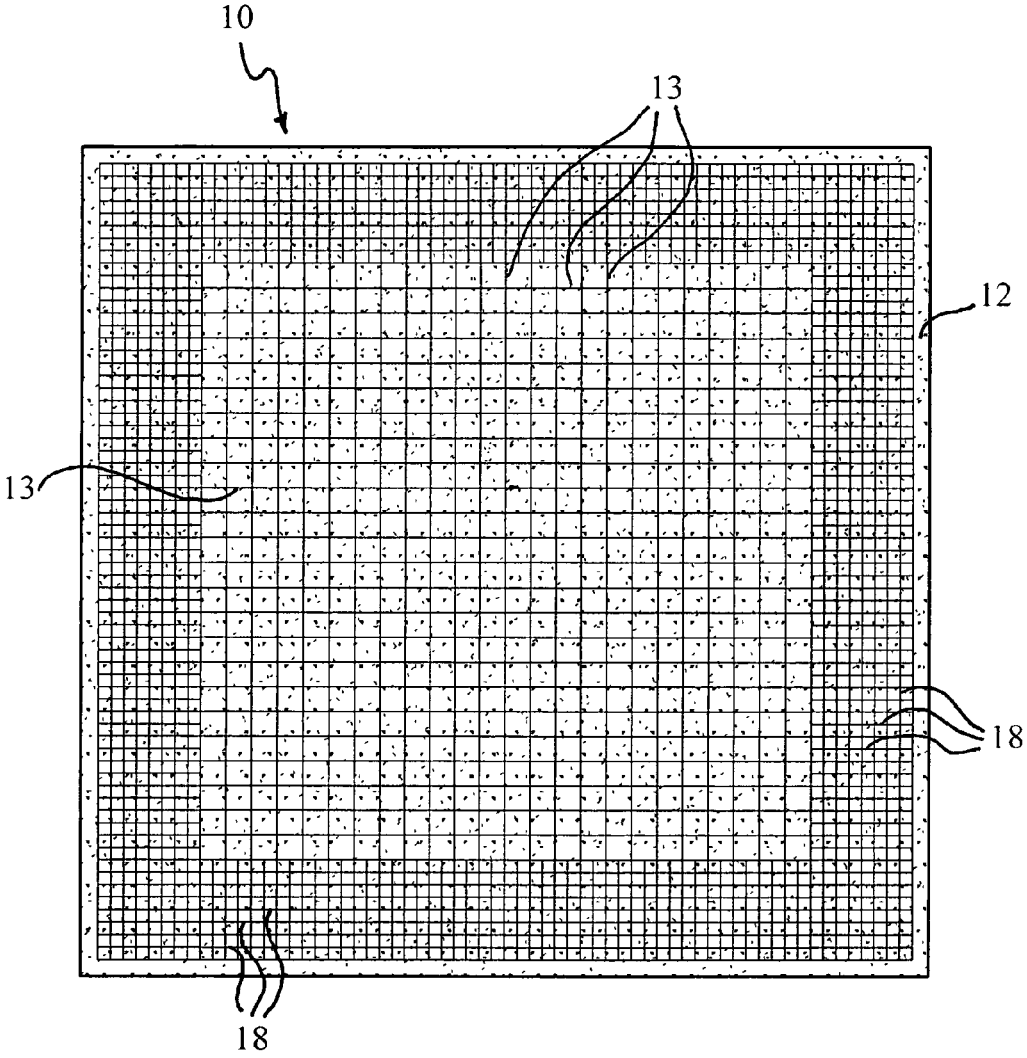
FIG. 1 is a top view of the shrinkage compensating slab construction showing the first and second plurality of reinforcing bars defining the centroid and peripheral portions.
Figure 2:
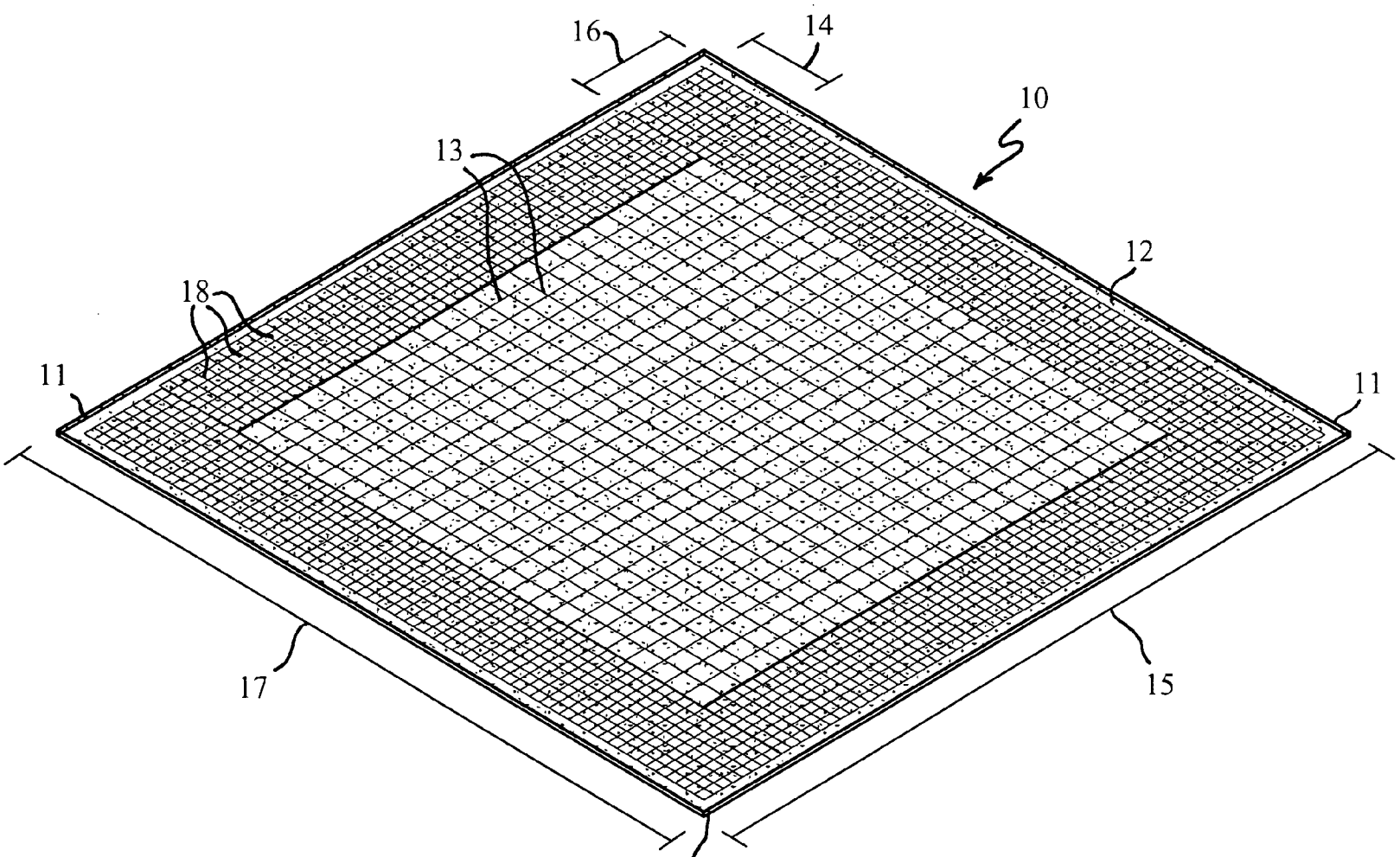
FIG. 2 is an isometric projection of the disclosure illustrated in FIG. 1.
Figure 3:
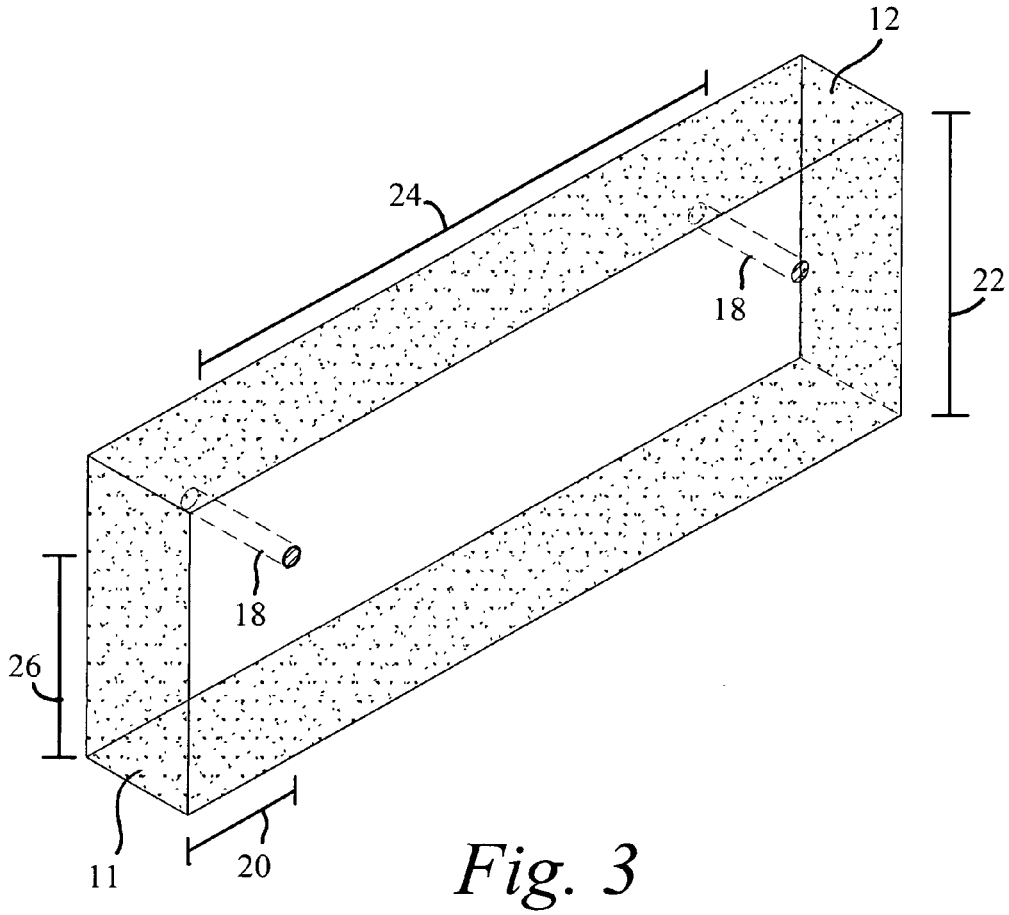
FIG. 3 is an isometric projection showing a sectional end view of a peripheral portion of the shrinkage compensating concrete slab, the major outer and inner faces defining the slab thickness, the peripheral margin surrounding the peripheral portion which is devoid of reinforcement, and a desired location of a preferred horizontal plane for embedding the reinforcing bars within the slab.
Figure 4:
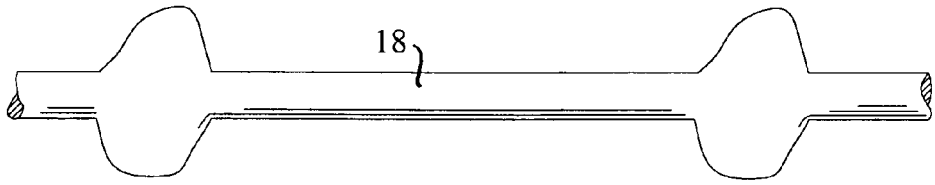
FIG. 4 is a side view of a preferred embodiment of the deformed nature of the reinforcing bars.

Turning now to the drawings figures, a reinforced concrete building structure, in the form of a shrinkage compensating concrete slab 10, is provided. The slab 10 has a centroid portion defined by a first plurality of reinforcing bars 13, and a peripheral portion, which is defined by a second plurality of reinforcing bars 18. Under normal circumstances, the shrinkage compensating concrete slab actively expands and shrinks, after pouring, in a direction which is normal to the centroid portion such that the forces are additively accumulated into the peripheral portion. In accordance with the present invention, a plurality of first and second deformed reinforcing bars 13, 18, respectively, are embedded within the concrete slab 10 and lie substantially parallel to the major outer 12 and inner faces of the slab 10. The reinforcing bars 13, 18 are, for example, typically deformed, as illustrated by reinforcing bar 18 in drawing FIG. 4. This type of reinforcing bar is well known in the art and includes a plurality of evenly spaced apart peripheral ribs, or ridges, disposed along the length of bar 18. The plurality of reinforcing bars 13, 18 are embedded, or cast, to lie in a single plane, and are desirably spaced from outer surface 12 a distance 26 which is equal to about one-third, from the outer face 12, of the total thickness of the slab 10. The deformed reinforcing bars 13, 18 are neither post-tensioned nor pre-tensioned. This construction specifically departs from the prior art in-so-far as it is calculated to avoid the necessary pitfalls often associated with such Portland cement slab constructions, as they relate to the otherwise additional costs associated in the use of pre-tensioned or post-tensioned wire or cable assemblies.

The plurality of second reinforcing bars 18, according to the present invention, are restricted to peripheral portion and are preferably aligned tangentially, or normal, to the expansive and shrinkage forces to elastically restrain the forces. In this regard, while not shown, it is specifically contemplated herein the first and second reinforcing bar arrays may be arranged in a longitudinal and perpendicular, radial, or circumferential orientations depending on the desired use and configuration of the slab 10 to be construction. Moreover, the second reinforcing bars 18 act in a manner so as to simulate an internally developed tension ring extending about the slab 10. The centroid portion of the slab 10 is defined by the first plurality of reinforcing bars 13, which are embedded on the same plane, and are located integral with and parallel to the second reinforcing bars 18. As a result, in construction, the first set of reinforcing bars 13, may be constructed to extend to the outer periphery of the peripheral portion with the remaining bars to comprise the second set of reinforcing bars 18 to be located between the first set, or each set of reinforcing bars 13, 18 could be deployed as separate constructions, or in any other manner so-long-as the presently conceived configuration is established. The first 13 and the second 18 plurality of reinforcing bars are aligned so that they extend in a longitudinal and perpendicular direction, with respect to one another, and the length and width of the bulkheads 15, 17 of the slab, respectively. In the preferred embodiment, an outer peripheral margin 20 is constructed which surrounds the peripheral portion and is completely devoid of any reinforcing bars.

Example

The following example, which is provided by way of illustration and without limitation, illustrates a slab 10 construction with a square pour area having a bulkhead length of 30 m, and a bulkhead width of 30 m. Pouring of the shrinkage compensating concrete slab 10, results in a construction having a major outer 12 and inner faces. With this example, the faces define a slab thickness of 20.32 cm. The centroid portion is 22.68 m and is surrounded by the peripheral portion. The centroid portion is defined by the perpendicular and longitudinal aligned array of the first plurality of reinforcing bars 13. The reinforcing bars 13 are an Imperial sized #4, being 1.27 cm in diameter. The reinforcing bars 13, 18 are deformed and are non-prestressed and non-post stressed steel. The bars are embedded on a plane which lies 13.41 cm from the inner face of the slab, and downwardly from the outer face 12 to approximately ⅓ of the slab thickness (6.71 cm). In this manner, the first plurality of #4 reinforcing bars 13 are aligned in a spaced relationship extending tangentially from one another in a first on-centers-each-way ("OCEW") orientation dimension having a first predetermined distance of 91.44 cm.

With this example, the active expansive and shrinkage forces are assumed to be normally concentrated in the peripheral portion in a direction which is normal to the bulkhead length 15 and width 17. The second plurality of reinforcing bars 18 are also Imperial #4, and are embedded within the peripheral portion of the concrete slab 10 in a second array which is substantially intersecting and coplanar with the first reinforcing bars 13. The second plurality of reinforcing bars 18 are restricted to the peripheral portion, and are aligned on a second spaced relationship extending tangentially from one another in a second OCEW orientation dimension having a predetermined distance of 45.72 cm. In this manner, the peripheral portion establishes a mat array, which acts not unlike a tension ring, surrounding the centroid portion which is 3.66 m, for each direction 14, 16, and extends 29.85 m along the bulkhead length 15 and width 17. As a result, it is may be readily apparent to one of skill in the art, that with this example, the second OCEW spaced relationship is configured in a spaced distance which is ½ that of the first OCEW spaced relationship (e.g. 45.72 cm versus 91.44 cm). It necessarily follows that in use, with this construction, at least one important consideration is an overall cost savings in both labor and materials without any diminution in the value to the installation in providing exceptional expansive and shrinkage restraint characteristics for the slab when required as a component in the overall construction of a building structure.

The foregoing example further illustrates, without limitation, at least one other preferred configuration where it is shown, for example, a 7.62 cm peripheral margin 20 is surrounding the 3.66 m peripheral portion 14, 16 so that the 7.62 cm margin 20 extends from the peripheral portions 14, 16 to the peripheral edges 11 of the slab 10, and wherein the second reinforcing bars 18 terminate at the margin 20.

Consistent with the preferred embodiment, and because the foregoing example illustrates its use in a square pour construction, the peripheral portion has a reinforcing length and a reinforcing width of 3.66 m. Because the bulkhead length and with is 30 m, this exemplified construction is not inconsistent with the preferred design perimeters where it is desired that the reinforcing length 16 is a minimum of 13% of the bulkhead length 15, and that the reinforcing width 14 is a minimum of 13% of the bulkhead width 17.

As one of skill in the art may readily appreciate, the configuration of the first 13 and second 18 reinforcing bars, in relation to their OCEW orientation and predetermined depth of the embedding plane from the outer face 12, is variable in any predetermined manner. Variances in these design parameters may include, without limitation, one's predetermined allowance for any variance, in thickening, lengthening, temperature, time, pressure, altitude and/or other such chemical, physical, or environmental circumstances each of which one will take into consideration as a function of the potential formulation of the shrinkage compensation concrete slump to be used in the pour of the slab and for its desired use.

While the present invention has been described in connection with the embodiments as described and illustrated above, it will be appreciated and understood by one of ordinary skill in the art that certain modifications may be made in accordance with the present invention, and the above preferred embodiments, without departing from the true spirit and scope of the invention, as described and claimed herein.

I claim:

1. A reinforced concrete building structure, comprising:

(a) a shrinkage compensating concrete slab of a predetermined thickness having a centroid portion surrounded by a peripheral portion, active expansive and shrinkage forces being normally concentrated in the peripheral portion;

(b) a first plurality of non-post-tensioned and non-pretension, deformed reinforcing bars embedded within the concrete slab and lying on a plane substantially parallel to major outer and inner faces of the slab, the plane being spread from the outer face of the slab a distance equal to about one third the thickness of the slab, and the plurality of reinforcing bars being restricted to the peripheral portion and being aligned with the expansive and shrinkage forces to elastically restrain the forces and to maximize the efficiency of the reinforcement and to thereby act as an internally developed tension ring said first plurality of reinforcing bars aligned in a first substantially parallel and perpendicular aligned array having a first on-centers-each-way dimension; and (c) a second plurality of non-post-tensioned and non-pretension, deformed reinforcing bars embedded within the concrete slab and lying on the plane, and the second plurality of reinforcing bars being restricted to the centroid portion and being aligned with the expansive and shrinkage forces to elastically restrain the forces and to maximize the efficiency of the reinforcement and to thereby act as an internally developed centroid tension, said second plurality of reinforcing bars aligned in a second substantially parallel and perpendicular aligned array having a second on-centers-each-way dimension, and whereas said first on-centers-each way dimension is equal to about one-third to one-half said second on-centers-each-way dimension.

2. The reinforced concrete building structure according to claim 1, wherein the slab includes peripheral edges defining a bulkhead length and a bulkhead width and the peripheral portion has a reinforcing length that is not less than 12% of the bulkhead length and a reinforcing width that is not less than 12% of the bulkhead width.

3. The reinforced concrete building structure according to claim 1, further comprising a peripheral margin surrounding the peripheral portion which is devoid of any reinforcing bars.

4. The reinforced concrete building structure according to claim 1, wherein the reinforcing bars are selected from a group including #3, #4, #5, #6 and #7 Imperial size rebar.

5. The reinforced concrete building structure according to claim 1, wherein the first dimension is approximately 91 cm and the second dimension is approximately 46 cm.

* * * * *